US006920671B2

(12) United States Patent
Graf

(10) Patent No.: US 6,920,671 B2
(45) Date of Patent: Jul. 26, 2005

(54) SAWTOOTH WIRE

(75) Inventor: Ralph A. Graf, Freienbach (DE)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 10/681,832

(22) Filed: Oct. 8, 2003

(65) Prior Publication Data

US 2004/0128800 A1 Jul. 8, 2004

(30) Foreign Application Priority Data

Oct. 10, 2002 (DE) ..... 102 47 215

(51) Int. Cl.[7] ..... D01G 15/84
(52) U.S. Cl. ..... 19/114
(58) Field of Search ..... 19/98, 99, 102–105, 19/106 R, 110, 111–113, 114; 76/112; 83/835, 846; 140/97

(56) References Cited

U.S. PATENT DOCUMENTS

| | | | | | |
|---|---|---|---|---|---|
| 2,937,413 | A | * | 5/1960 | Hollingsworth | 19/114 |
| 4,653,152 | A | * | 3/1987 | Wada | 19/114 |
| 4,854,012 | A | * | 8/1989 | Graf | 19/114 |
| 4,964,195 | A | | 10/1990 | Hollingsworth | |
| 5,428,949 | A | | 7/1995 | Stahlecker | |
| 5,555,714 | A | * | 9/1996 | Mladek et al. | 57/408 |
| 5,581,848 | A | * | 12/1996 | Egerer | 19/114 |
| 6,185,789 | B1 | * | 2/2001 | Hollingsworth et al. | 19/114 |
| 6,408,487 | B1 | * | 6/2002 | Atkinson | 19/114 |
| 6,523,226 | B2 | * | 2/2003 | Graf | 19/114 |

FOREIGN PATENT DOCUMENTS

| | | |
|---|---|---|
| DE | 4038352 | 6/1992 |
| DE | 100 12 561 A1 | 10/2001 |
| FR | 2821863 | 9/2002 |
| GB | 854090 | 2/1957 |

* cited by examiner

*Primary Examiner*—Gary L. Welch
(74) *Attorney, Agent, or Firm*—Friedrich Kueffner

(57) ABSTRACT

A sawtooth wire for producing all-steel sawtooth clothing for the doffer and/or doffing cylinder of a carding machine with a plurality of teeth successively arranged in the longitudinal direction of the wire. Each tooth has a tooth breast beginning at the tooth bottom and extending in the direction toward the tooth tip and a tooth back that is connected with the tooth breast by two tooth flanks extending parallel to the longitudinal direction of the wire and that extends from the tooth tip in the direction of the following tooth bottom. At least one tooth flank has at least one profile segment that is located between the tooth tip and the tooth bottom and is provided with profiling.

20 Claims, 2 Drawing Sheets

SAWTOOTH WIRE

BACKGROUND OF THE INVENTION

The present invention relates to a sawtooth wire for producing an all-steel sawtooth clothing for the doffer and/or doffing cylinder of a carding machine with a plurality of teeth successively arranged in the longitudinal direction of the wire. Each tooth has a tooth breast beginning at the tooth bottom and extending in the direction toward the tooth tip and a tooth back, which is connected with the tooth breast by two tooth flanks extending parallel to the longitudinal direction of the wire and which extends from the tooth tip in the direction of the following tooth bottom. The invention further relates to a method for producing sawtooth wires of this type.

A carding machine is used in the production of yarns for the purpose of aligning and cleaning the textile fibers that form the yarns. For this purpose, the textile fibers are supplied by means of a supply roller to a so-called swift. This is a cylindrical element whose cylindrical surface is provided with all-steel hook or sawtooth clothing and is rotated about the cylinder axis. The swift clothing, possibly together with the card flat rods distributed over the cylindrical surface of the swift, aligns and cleans the supplied textile fibers during rotation of the swift. After this aligning and cleaning operation, the fiber fleece obtained in this way is removed from the swift by means of a so-called doffer and/or doffing cylinder and transported to further processing stations. The doffers and/or doffing cylinders usually also have all-steel sawtooth clothing in the area of their cylindrical surface, which, in the course of rotation of the doffer and/or doffing cylinder, engages the fiber fleece that is entrained by the swift or a doffing cylinder and removes it from the swift or the doffing cylinder.

Particularly in the processing of especially fine-denier fibers of natural or synthetic polymers, it has been found that the transfer of the fiber fleece from the swift to the doffer or doffing cylinder presents problems. This causes the swift clothing to become filled with fiber material that has not been removed, which causes unsatisfactory alignment and cleaning of the supplied textile fibers by the swift.

Moreover, it was found that the fiber fleece removed by the doffing cylinder, particularly in the case of higher production weights, is prematurely removed from the doffer or doffing cylinder, and this can result in problems during further processing of the fiber material.

To eliminate these problems, it has already been suggested that the sawteeth of the all-steel sawtooth clothing of the doffer or doffing cylinder be provided with lateral rolled groove arrangements. It was found, however, that, especially in high-capacity carding machines with production capacities of 80 kg or more, at the high peripheral speeds of the doffer or doffing cylinder necessary to maintain this production capacity, premature detachment of the fiber fleece from the doffer or doffing cylinder occurs. This occurs despite the rolled groove arrangements, which promote greater adhesion.

To solve this problem, DE 100 12 561 proposes a modification of the well-known sawtooth wires, in which, in addition to the rolled groove arrangement, profiling of the tooth backs of the sawteeth is provided. In the profiling, at least one tooth has a convex segment that passes over into a concave segment in the direction of the tooth bottom. In the sawtooth wires described in the cited document, this profiling can be designed both in the form of recesses and in the form of projections in the region of the tooth backs. With sawtooth wires of this type, an adhesive force can be made available that is sufficient even for the operation of high-capacity carding machines. Of course, especially in the processing of synthetic fibers with a fineness of 0.8–40 dtex, especially silicone-treated synthetic fibers, and in the processing of fine wool, it was found to be a problem that a satisfactory yarn quality cannot be achieved with the sawtooth wires described in DE 100 12 561 at high production speeds.

SUMMARY OF THE INVENTION

In view of these problems in the state of the art, the object of the present invention is to provide sawtooth wires for producing all-steel clothing for doffers and/or doffing cylinders of a carding machine, which allow high production speed and at the same time guarantee high yarn quality.

In accordance with the invention, this objective is achieved by a modification of the well-known sawtooth wires, which is essentially characterized by the fact that at least one tooth flank of at least one sawtooth has at least one profile segment that is arranged between the tip of the tooth and the bottom of the tooth and is provided with profiling.

The invention is based on the recognition that the problems observed with the use of well-known sawtooth wires are due to the fact that the clothing strips of the all-steel clothing of the doffers and/or doffing cylinders become filled with fiber material, if the sawtooth wires used to produce this clothing have flank profiling to maintain the necessary adhesive force. In the sawtooth wires in accordance with the invention, this deficiency is eliminated by providing the profiling necessary to create the required adhesive force only between the tooth bottom and the tooth tip. This profiling does not extend along the blade flank in the direction of the foot of the tooth beyond the tooth cut depth. In this way, on the one hand, a sufficient adhesive force can be provided for the fibers removed by the swift or another preceding processing unit, while, on the other hand, the removal of the fibers from the clothing is possible without any problems, so that filling of the clothing strips is ultimately prevented. This allows the production of high-quality yarns at high production speeds.

From the standpoint of production engineering, the profile segment provided between the tooth bottom and the tooth tip can be produced especially easily, if it has at least one profile ridge, which preferably runs approximately parallel to the longitudinal direction of the wire, and/or at least one profile groove, which preferably runs approximately parallel to the longitudinal direction of the wire, because the profiling can be produced simultaneously with the remaining shaping of the wire in sawtooth wires of this type. In this regard, it is especially advantageous from the standpoint of production engineering, if the profile segment that has at least one profile groove is located in a tooth flank aligned with the adjacent dedendum flank.

To prevent damage to the fibers and to maintain a desired staple flow, it has been found to be especially effective, if at least one profile ridge and/or at least one profile groove has an arc-shaped border at least in certain sections in a sectional plane running perpendicularly to the longitudinal direction of the profile ridge and/or profile groove. In this way the formation of sharp edges in the course of the profile segment is avoided. To produce a high adhesive force and simultaneously avoid fiber damage and ensure complete fiber removal from the clothing, it is advantageous, if the arc-shaped border section has a radius of curvature in a sectional plane running perpendicularly to the longitudinal direction of the profile ridge or the profile groove in a range of 0.05–0.5 mm, preferably 0.1–0.3 mm, and especially about 0.15 mm.

If at least one of the profile segments has a plurality of profile grooves running approximately parallel to the longitudinal direction of the wire, it is advantageous if at least one of the profile grooves has a lesser profile depth than the profile groove located on the side of this profile groove facing the bottom of the tooth. This ensures complete detachment of the fiber fleece from the clothing and simultaneously guarantee a high adhesive force and sufficient stability of the teeth, which usually taper from the tooth bottom to the tooth tip. This means that the profile depths of the profile grooves increase towards the bottom of the tooth, so that the thickness of the teeth, which generally increases in this direction, can be well utilized without adversely affecting stability.

To preserve a good compromise between adhesive force, on the one hand, and complete fiber detachment, on the other hand, it was found to be advantageous, if an essentially flat transition segment is present between at least two adjacent profile grooves or ridges of a profile segment. In this case, fiber damage can be reliably prevented, if the transition between the transition segment and at least one adjacent profile ridge or one adjacent profile groove is rounded with a radius of curvature in the range of 0.01–0.05 mm, and preferably about 0.02 mm.

Especially in the processing of synthetic fibers, especially silicone-treated synthetic fibers with a fineness of 0.8–40 dtex, it was found to be especially advantageous for the production of good yarn qualities at high production speeds, if the one or more profile ridges and/or the one or more profile grooves have a profile height or profile depth of at least 0.02 mm, preferably at least 0.04 mm, and especially at least 0.05 mm, and/or the individual profile grooves or profile ridges of a profile segment are separated from one another by a distance in the range of 0.1–0.6 mm, preferably 0.2–0.4 mm, and especially about 0.3 mm.

If each tooth flank of a tooth has a profile segment, excessive adhesive force that promotes filling of the clothing can be prevented, if the profile segment located on one of the tooth flanks is located in a staggered position in the height direction from the bottom of the tooth to the tip of the tooth with respect to the profile segment located on the other tooth flank.

In this regard, the profile segment located on one of the tooth flanks can have one or more profile grooves, while the profile segment located on the other tooth flank can have one or more profile ridges.

With respect to maintaining satisfactory stability of the teeth, it was found to be advantageous, in regard to the fact that the teeth usually taper from the tooth bottom to the tooth tip in a sectional plane running perpendicularly to the longitudinal direction of the wire, if the profile segment located closer to the bottom of the tooth has at least one profile groove, and/or the profile segment located closer to the tip of the tooth has at least one profile ridge.

In addition to the profiling of the tooth flanks, the tooth backs of the teeth of the sawtooth wires of the invention may be profiled in ways that are already well known, such that the tooth back of at least one tooth has at least one convex section that passes over into a concave section in the direction of the bottom of the tooth. Clothing of this type is described in DE 100 12 561. The disclosed content of the cited document with respect to the profiling of the tooth backs is herewith incorporated in the present specification by explicit reference.

As may be derived from the preceding explanation of the sawtooth wires of the invention, a method for producing these sawtooth wires, in which a starting material is formed into a wire that has a blade section, and then sawteeth are stamped into this blade section, is essentially characterized by the fact that the blade section is profiled during the forming operation.

The invention is explained below with reference to the drawings, which are referred to with respect to all details that are essential to the invention and were not specifically brought out in the specification.

DETAILED DESCRIPTION OF THE PREFERRED EMBODIMENTS

Figure 1:
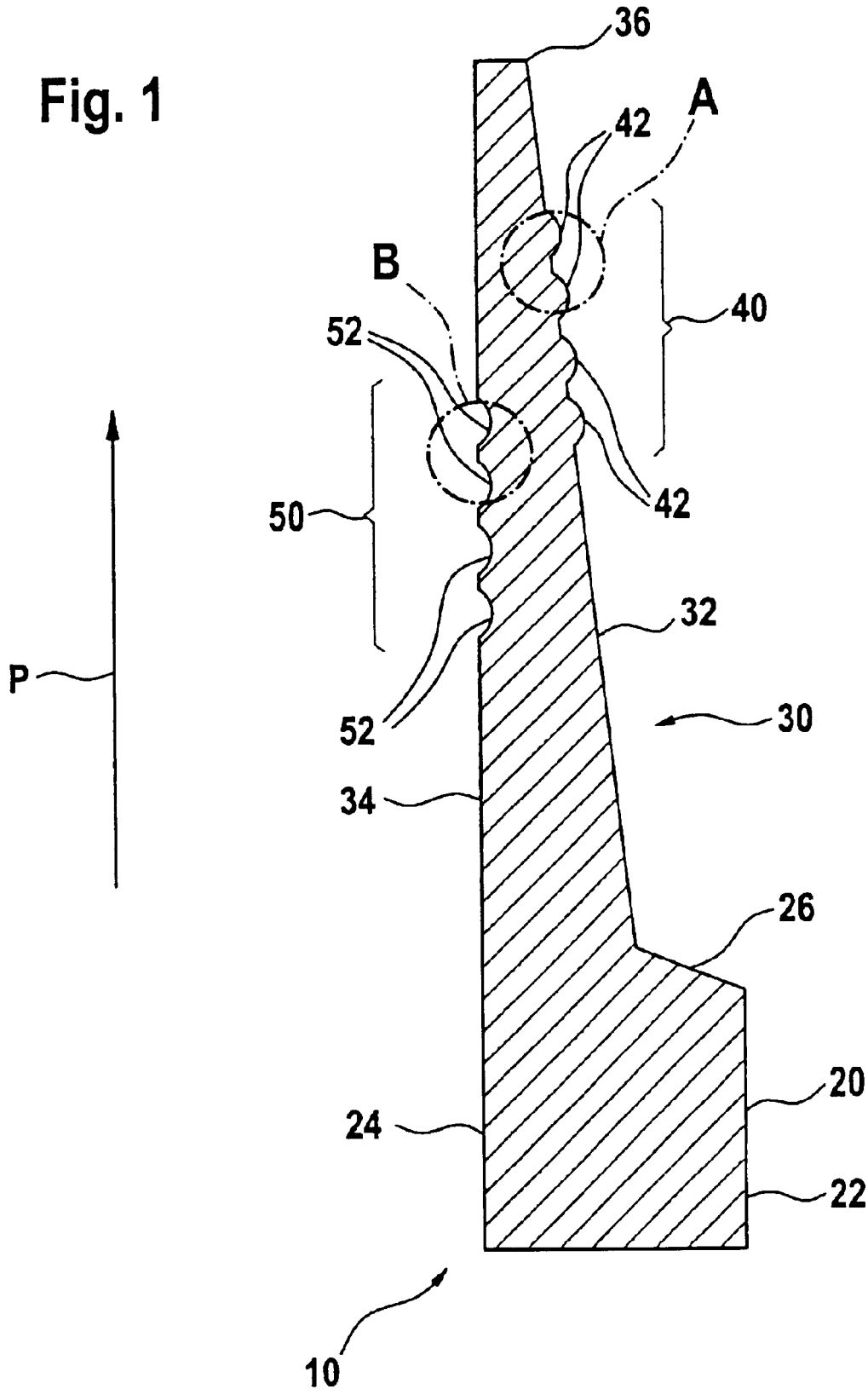
FIG. 1 shows a sectional view of a sawtooth wire in accordance with the invention in a sectional plane running perpendicularly to the longitudinal direction of the wire.

The sawtooth wire 10 shown in FIG. 1 for producing clothing for the doffing cylinder of a carding machine comprises a dedendum region 20 with a dedendum flank 22, which passes over into a tooth flank of a blade section 30 via a shoulder 26, and with a dedendum flank 24, which is flush with a tooth flank 34. A plurality of sawteeth, which are not shown in detail in the drawing, are formed in the blade section 30 by suitable stamping operations. The blade section 30 is bounded by the tooth flanks 32 and 34 in the sectional plane shown in FIG. 1, which extends perpendicularly to the longitudinal direction of the wire. The blade tapers from the dedendum section 20 towards the tooth tips 36.

Each of the tooth flanks 32 and 34 has a profile segment 40 and 50, respectively, and both profile segments 40 and 50 are located between the tooth bottom and tooth tip 36 of each tooth formed in the blade section 30.

The profile segment 50 is located in a staggered position relative to the profile segment 40 in the height direction indicated by the arrow P.

Figure 2:
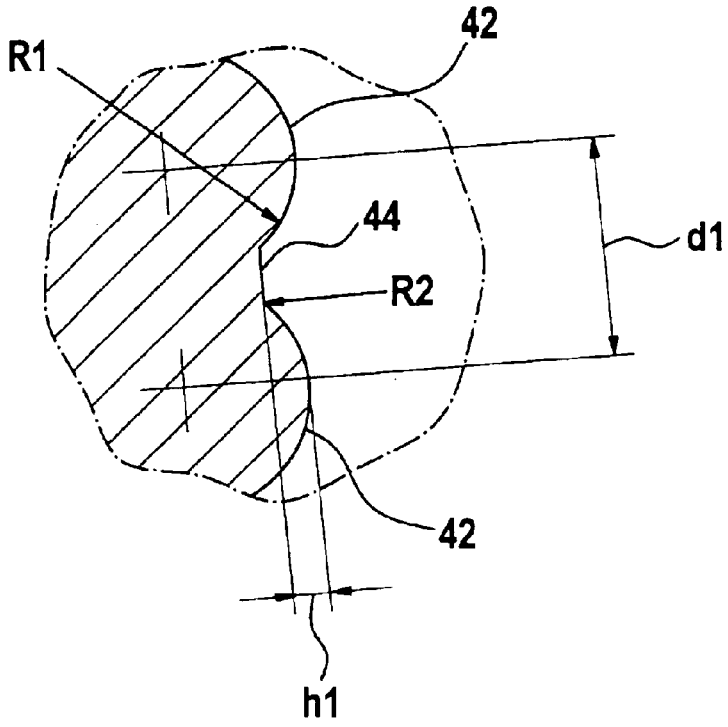
FIG. 2 shows a detail view of sawtooth wire section A in FIG. 1.

The profile segment 50, which is located closer to the bottom of the tooth and in the tooth flank 34 that is flush with the dedendum flank 24, has a total of four profile grooves 52, while the profile segment 40, which is located closer to the tip 36 of the tooth, has a total of four profile ridges 42. As can be seen in FIG. 1, one of the profile grooves 52 has a lesser profile depth than an adjacent profile groove located on a side of the profile groove facing the bottom of the tooth. As is shown especially clearly in the detail view in FIG. 2, essentially flat transition segments 44 are located between the individual profile ridges 42. In this regard, the summit points of the profile ridges, which have an arc-shaped border in the sectional plane running perpendicularly to the longitudinal direction of the wire, are separated by a distance d1 of 0.29 mm. In the embodiment of the invention shown in the drawing, the radius of curvature R1 of the profile ridges with an arc-shaped border in the sectional plane running perpendicularly to the longitudinal direction of the wire is 0.15 mm. The transition between the transition segment 44 and the profile ridges 42 is rounded with a radius of curvature R2 of 0.02 mm. The height h1 of the profile ridges 42 is 0.05 mm in the embodiment of the invention shown in the drawings.

Figure 3:
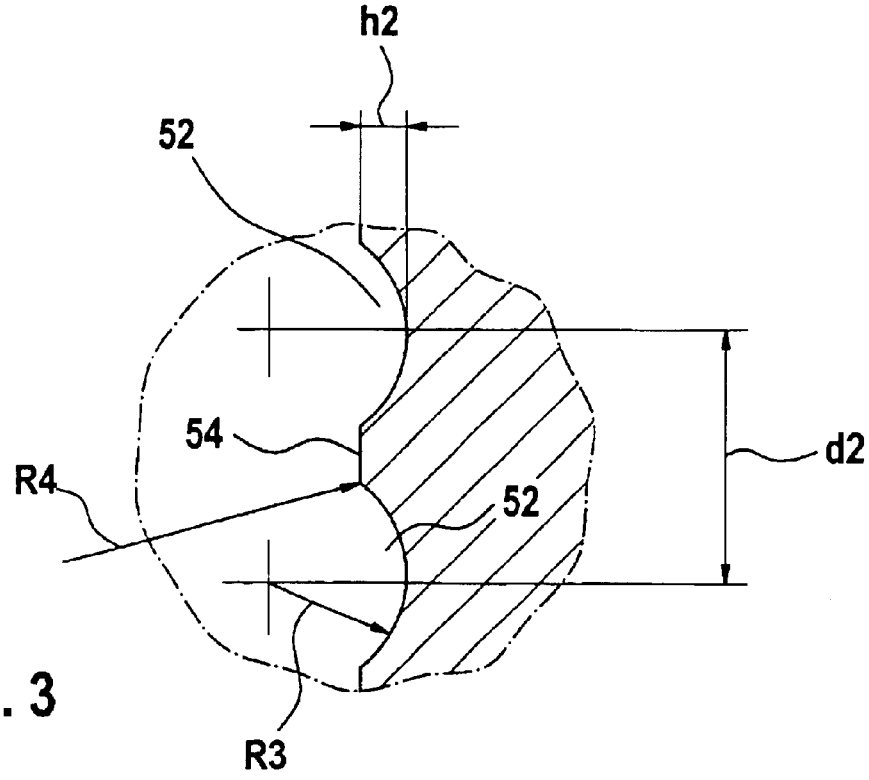
FIG. 3 shows a detail view of sawtooth wire section B in FIG. 1.

As is shown especially clearly in FIG. 3, an essentially flat transition segment 54 is also located between the individual profile grooves 52 of the profile segment 50. The profile grooves 52 of the profile segment 50 also have an arc-shaped border, and in this case as well, the radius of curvature R3 of the profile grooves 52 is 0.15 mm in a sectional plane running perpendicularly to the longitudinal direction of the wire 10. The profile grooves 52 are also separated from one another by a distance d2 of 0.29 mm. The transition between the profile grooves 52 and the transition segment 54 is rounded with a radius of curvature R4 of 0.02 mm. The depth h2 of the profile grooves 52 is 0.05 mm for all of the profile grooves 52 in the embodiment of the invention shown in the drawings.

The invention is not limited to the embodiment explained with reference to the drawings, but rather the use of sawtooth wires in which only one tooth flank is provided with a profile segment is also possible. Furthermore, profile segments located on both tooth flanks may have both profile grooves and profile ridges. In addition, the profile grooves may have a profile depth that increases towards the dedendum section 20. Of course, an essential aspect of the invention is that the profile segments do not extend beyond the tooth cut depth in the direction of the dedendum section 20.

The invention is not limited by the embodiments described above which are presented as examples only but can be modified in various ways within the scope of the protection defined by the appended patent claims.

What is claimed is:

1. A sawtooth wire for producing all-steel sawtooth clothing for a doffer and/or a doffing cylinder of a carding machine, the sawtooth wire comprising a plurality of teeth successively arranged in a longitudinal direction of the wire, each tooth having a tooth breast beginning at a tooth bottom and extending in a direction toward a tooth tip, and a tooth back that is connected with the tooth breast by two tooth flanks extending parallel to the longitudinal direction of the wire and extends from the tooth tip in a direction of a tooth bottom of a following tooth, at least one of the tooth flanks having at least one profile segment located between the tooth tip and the tooth bottom and provided with profiling, wherein the profile segment has one profile ridge and a plurality of profile grooves running substantially parallel to the longitudinal direction of the wire, and the profile groove has a lesser profile depth than an adjacent profile groove located on a side of the profile groove facing the bottom of the tooth.

2. The sawtooth wire in accordance with claim 1, wherein the profile ridge runs substantially parallel to the longitudinal direction of the wire.

3. The sawtooth wire in accordance with claim 1, wherein the profile groove runs substantially parallel to the longitudinal direction of the wire.

4. The sawtooth wire in accordance with claim 1, wherein the at least one of the profile ridge and the profile groove has an arc-shaped border at least in certain sections in a sectional plane that runs perpendicularly to a longitudinal direction of at least one of the profile ridge and the profile groove.

5. The sawtooth wire in accordance with claim 4, wherein the arc-shaped border section has a radius of curvature in a range of 0.05–0.5 mm in a sectional plane running perpendicularly to the longitudinal direction of the at least one of the profile ridge and the profile groove.

6. The sawtooth wire in accordance with claim 5, wherein the radius of curvature is in a range of 0.1–0.3 mm.

7. The sawtooth wire in accordance with claim 6, wherein the radius of curvature is about 0.15 mm.

8. The sawtooth wire in accordance with claim 1, wherein an essentially flat transition segment is located between at least two adjacent profile ridges or grooves of a profile segment.

9. The sawtooth wire in accordance with claim 8, wherein a transition between the transition segment and at least one adjacent profile ridge or one adjacent profile groove is rounded with a radius of curvature in a range of 0.01–0.05 mm.

10. The sawtooth wire in accordance with claim 9, wherein the transition has a radius of curvature of about 0.02 mm.

11. The sawtooth wire in accordance with claim 1, wherein the profile ridge and the profile groove respectively have a profile height and a profile depth of at least 0.02 mm.

12. The sawtooth wire in accordance with claim 11, wherein the profile height and the profile depth are at least 0.04 mm.

13. The sawtooth wire in accordance with claim 12, wherein the profile height and the profile depth are at least 0.05 mm.

14. The sawtooth wire in accordance with claim 1, wherein at least one tooth tapers from the bottom of the tooth to the tip of the tooth in a sectional plane running perpendicularly to the longitudinal direction of the wire.

15. The sawtooth wire in accordance with claim 1, wherein each tooth tapers from the bottom of the tooth to the tip of the tooth in a sectional plane running perpendicularly to the longitudinal direction of the wire.

16. The sawtooth wire in accordance with claim 1, wherein the tooth back of at least one tooth has at least one convex segment that passes over into a concave segment in a direction of the bottom of the tooth.

17. A sawtooth wire for producing all-steel sawtooth clothing for a doffer and/or a doffing cylinder of a carding machine, the sawtooth wire comprising a plurality of teeth successively arranged in a longitudinal direction of the wire, each tooth having a tooth breast beginning at a tooth bottom and extending in a direction toward a tooth tip, and a tooth back that is connected with the tooth breast by two tooth flanks extending parallel to the longitudinal direction of the wire and extends from the tooth tip in a direction of a tooth bottom of a following tooth, at least one of the tooth flanks having at least one profile segment located between the tooth tip and the tooth bottom and provided with profiling, wherein the profile segment has at least one of at least one profile ridge and at least one profile groove, wherein individual profile grooves and profile ridges of a profile segment are separated from one another by a distance in a range of preferably 0.2–0.4 mm.

18. The Sawtooth wire in accordance with claim 17, wherein individual profile grooves and profile ridges of a profile segment are separated from one another by a distance of about 0.3 mm.

19. A sawtooth wire for producing all-steel sawtooth clothing for a doffer and/or a doffing cylinder of a carding machine, the sawtooth wire comprising a plurality of teeth successively arranged in a longitudinal direction of the wire, each tooth having a tooth breast beginning at a tooth bottom and extending in a direction toward a tooth tip, and a tooth back that is connected with the tooth breast by two tooth flanks extending parallel to the longitudinal direction of the wire and extends from the tooth tip in a direction of a tooth bottom of a following tooth, at least one of the tooth flanks having at least one profile segment located between the tooth tip and the tooth bottom and provided with profiling, wherein in at least one tooth, both tooth flanks have at least one profile segment so that the profile segment located on one of the tooth flanks is staggered relative to the profile segment located on the other tooth flank in a height direction of the tooth extending from the bottom of the tooth to the tip of the tooth.

20. The sawtooth wire in accordance with claim 19, wherein at least one of the profile segment located closer to the bottom of the tooth has at least one profile groove, and the profile segment located closer to the tip of the tooth has at least one profile ridge.

* * * * *